US008643565B2

(12) United States Patent
Singh

(10) Patent No.: US 8,643,565 B2
(45) Date of Patent: Feb. 4, 2014

(54) LOW-PROFILE ANTENNA AND FEED STRUCTURE

(75) Inventor: Nicholas F. Singh, Apple Valley, MN (US)

(73) Assignee: Seeonic, Inc., Plymouth, MN (US)

( * ) Notice: Subject to any disclaimer, the term of this patent is extended or adjusted under 35 U.S.C. 154(b) by 189 days.

(21) Appl. No.: 13/312,825

(22) Filed: Dec. 6, 2011

(65) Prior Publication Data

US 2012/0139811 A1 Jun. 7, 2012

Related U.S. Application Data

(60) Provisional application No. 61/459,022, filed on Dec. 6, 2010.

(51) Int. Cl.
*H01Q 1/50* (2006.01)

(52) U.S. Cl.
USPC ..... 343/850; 343/700 MS

(58) Field of Classification Search
USPC ..... 343/850, 906, 700 MS, 846
See application file for complete search history.

(56) References Cited

U.S. PATENT DOCUMENTS 8,068,063 B2 * 11/2011 Hung et al. ..... 343/769
8,115,694 B2 * 2/2012 Lin et al. ..... 343/769

* cited by examiner

*Primary Examiner* — Hoang V Nguyen
(74) *Attorney, Agent, or Firm* — Merchant & Gould P.C.

(57) ABSTRACT

An antenna subsystem includes an antenna and a radio frequency (RF) feed structure. The antenna subsystem includes a signal layer, a ground plane layer, and a middle layer arranged therebetween. The RF feed includes a substrate, a port, and a conductive layer. The port is arranged and configured for selective coupling with a transmission line. A conductive layer includes a first portion electrically connected to the port, which transfers an RF signal between the transmission line and a signal layer. The conductive layer also includes a second portion electrically connected to the port, which electrically couples a ground conductor of the transmission line to the ground plane.

19 Claims, 10 Drawing Sheets

LOW-PROFILE ANTENNA AND FEED STRUCTURE

CROSS-REFERENCE TO RELATED APPLICATIONS

This application claims priority to U.S. Patent Application Ser. No. 61/459,022, filed on Dec. 6, 2010, titled METHOD FOR MANUFACTURING LOW-PROFILE ANTENNA WITH NOVEL FEED STRUCTURE, by Nicholas F. Singh, which is hereby incorporated by reference in its entirety.

BACKGROUND

Various devices require antenna systems that are capable of transmitting and receiving radio waves. One such device is a radio frequency identification (RFID) system for communication between an RFID reader and an RFID tag. A possible example of an RFID system is an inventory monitoring system used to track the quantity and location of products in an inventory.

SUMMARY

In general terms, this disclosure is directed to a low-profile patch antenna. In one possible configuration and by non-limiting example, the antenna includes an RF feed structure configured to accept a radio frequency (RF) transmission line and connect a ground plane with a signal layer.

One aspect is an RF feed structure comprising a substrate; at least one port coupled to the substrate and arranged and configured for selective coupling with a transmission line, the port providing an electrical connection with a signal conductor of the transmission line and an electrical connection with a ground conductor of the transmission line; a conductive layer arranged on at least one surface of the substrate, the conductive layer including at least a first portion and a second portion, wherein when the transmission line is coupled to the port, the first portion is electrically coupled to the signal conductor through the port, the first portion is arranged and configured to feed the signal to a feedpoint of a signal layer of an antenna, and the second portion is electrically coupled to the ground conductor through the port; and a ground plane interface configured to make an electrical connection with a ground plane of a radio frequency antenna, to electrically couple the ground plane with the second portion of the conductive layer and the ground conductor of the transmission line.

Another aspect is an RF antenna subsystem comprising a signal layer; a ground plane layer; a middle layer positioned between the signal layer and the ground plane layer; and at least one RF feed structure comprising a substrate; at least one port coupled to the substrate and arranged and configured for selective coupling with a transmission line, the port providing an electrical connection with a signal conductor of the transmission line and an electrical connection with a ground conductor of the transmission line; and a conductive layer arranged on at least one surface of the substrate, the conductive layer including a first portion electrically connected to the signal layer and electrically connected to the signal conductor to conduct a signal between the signal conductor and the signal layer; and a second portion electrically connected to the ground plane and electrically connected to the ground conductor.

A further aspect is a method for manufacturing an antenna subsystem, the method comprising forming a signal layer from a first conductive material; forming a middle layer from an electrically insulating material; forming a ground plane from a second conductive material; arranging the middle layer between the signal layer and the ground plane; forming at least one RF feed structure including at least a substrate and a port configured to receive a coaxial cable; physically connecting the substrate of the RF feed structure to the ground plane with at least one fastener; and electrically coupling the RF feed structure to the signal layer and to the ground plane, wherein the RF feed structure transfers a radio frequency signal between the coaxial cable and the signal layer.

DETAILED DESCRIPTION

Figure 1:
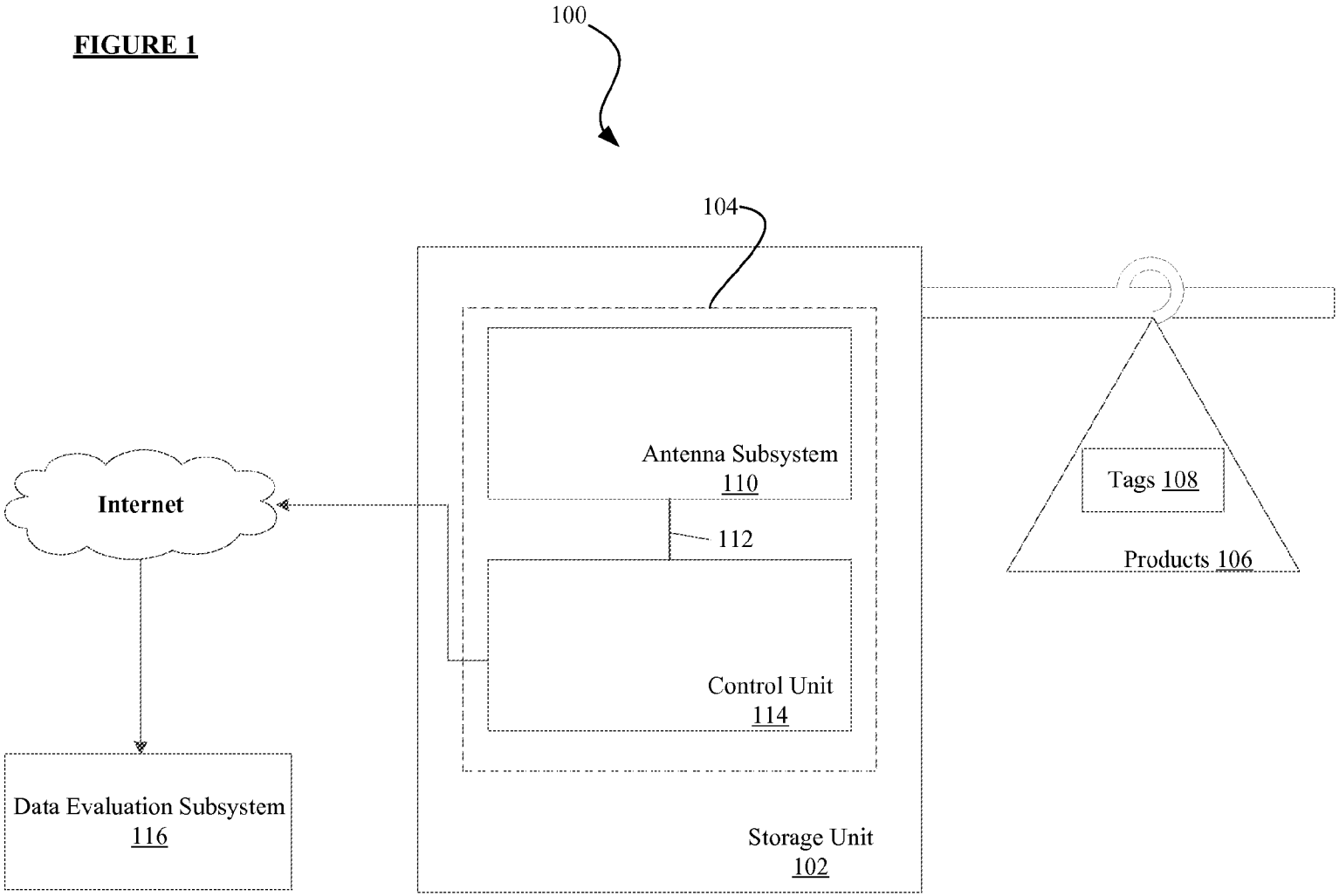
FIG. 1 is a schematic block diagram illustrating an example of an RFID inventory monitoring system.

Various embodiments will be described in detail with reference to the drawings, wherein like reference numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

FIG. 1 is a schematic block diagram of an example RFID inventory monitoring system 100. In this example, the inventory monitoring system 100 includes a storage unit 102 having an RFID tag reader system 104, products 106 having a tag 108, and a data evaluation subsystem 116. The RFID tag reader system 104 further includes an antenna subsystem 110, a transmission line 112, and a control unit 114.

The storage unit 102 is an assembly capable of supporting and displaying the products 106. The storage unit 102 further stores the RFID tag reader system 104. In some embodiments, the RFID tag reader system 104 may be retrofit into the storage unit 102. Examples of the storage unit 102 include a shelving unit, suitcase, or any other suitable compartment capable of supporting the RFID tag reader system 104. In the present example, products 106 are suspended from an extension of the storage unit 102; however, in alternative embodiments, products 106 may be positioned within the storage unit 102 or at a location away from the storage unit 102.

The RFID tag reader system 104 is configured to collect data about the products 106 stored within the storage unit 102. This data can then be transmitted to the data evaluation subsystem 116 that further evaluates the data, such as to determine when and if the products 106 need to be restocked to evaluate trends and predict when replenishment may be required, etc. The RFID tag reader system 104 collects such data through communication between the product tags 108 and the antenna subsystem 110. The RFID tag reader system 104 is relatively small in size and capable of installation within the storage unit 102.

The products 106 include tags 108 configured for communication with the RFID tag reader system 104. The product tags 108 are typically RFID tags that may be coupled to or directly connected to the products 106 or product packaging during the manufacturing process. Alternatively, the product tags 108 may be subsequently placed on the products 106, such as by a retail store or by a distributor. In alternative embodiments, the tags 108 may be any object configured to be detected by radio frequency signals generated by the RFID tag reader system 104, and specifically, the antenna subsystem 110.

The RFID tag reader system 104 is operable to communicate with the product tags 108 through the antenna subsystem 110. The antenna subsystem 110 has a conical radiation pattern which encompasses the product tags 108 to effectuate communication. In the example, the antenna subsystem 110 is positioned within the storage unit 102; however, in other embodiments, the antenna subsystem 110 may be positioned at any location at which the conical field pattern of the antenna subsystem 110 covers the product tags 108. Because the antenna subsystem 110 may be stored within the housing or casing of the storage unit 102, the antenna subsystem 110 itself does not require a protective casing that many other antenna subsystems often include. In this way, the antenna subsystem 110 can achieve a smaller, more light-weight size, which is capable of fitting in a wider range of storage units 102, such as, for example, a thin shelf of jewelry or a small suitcase of products. After receiving RF signals back from the product tags 108, the RF signals are transmitted by the antenna subsystem 110 through the transmission line 112 to the control unit 114, where data encoded within the RF signals is decoded, stored, and transmitted to the data evaluation subsystem 116 for further evaluation.

The transmission line 112 operates to communicate a signal between the antenna subsystem 110 and the control unit 114. An example of the transmission line 112 is a coaxial cable; however, any line capable of transmitting radio frequency signals is suitable. In some embodiments, the transmission line 112 is configured to properly operate at a specific characteristic impedance required by the antenna subsystem 110, and thus, must be matched to the impedance of the at least one antenna of the antenna subsystem 110. In one example, the transmission line 112 is a coaxial cable that is matched for 50 ohms and designed for applications around 915 MHz center frequency. Other impedances are used in other embodiments. In addition, some embodiments are configured and designed to operate at other center frequencies and within different radio frequency communication bands.

The control unit 114 receives the data collected by the antenna subsystem 110 from the transmission line 112. The control unit 114 then transmits the data to the data evaluation subsystem 116 which determines, for example, the quantity of products 106 at the storage unit 102, whether the products 106 need to be restocked, and the locations of products 106. In certain embodiments, the control unit 114 may issue requests for additional data from the antenna subsystem 110 such as operational status of the antenna subsystem 110 and ambient conditions.

Figure 2:
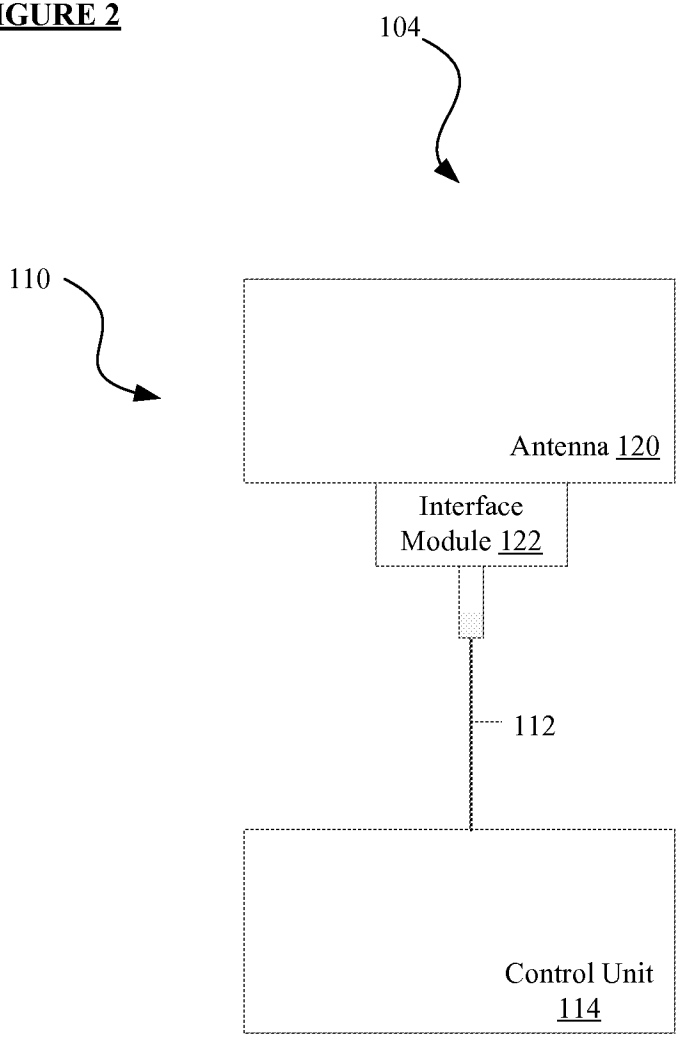
FIG. 2 is a schematic block diagram illustrating an example of an RFID tag reader system of an RFID inventory monitoring system.

FIG. 2 is a schematic block diagram illustrating one example of the RFID tag reader system 104 of FIG. 1. In this example, the RFID tag reader system 104 includes an antenna 120, an RF feed structure 122, the transmission line 112, and the control unit 114.

The RFID tag reader system 104 includes the antenna subsystem 110 configured to communicate with the product tags 108. In some embodiments, the antenna subsystem 110 is a low-profile patch antenna (described in more detail below) operable to function in conjunction with the RF feed structure 122. The antenna 120 collects required data from the product tags 108, which is then sent to the control unit 114 for transmittal and further processing. The antenna 120 directs electromagnetic energy at the product tags 108 to excite the tags 108 into attenuating a reflected signal back through the antenna 120. This is accomplished by pointing the antenna 120 at the product tags 108, thereby creating a conical field of high energy density capable of exciting an optimal number of product tags 108. Some embodiments include multiple antenna subsystems and multiple transmission lines 112. If multiple antennas subsystems are used, they are often configured in such a way that their conical fields overlap to provide greater levels of reliability and efficiency.

The RF feed structure 122 provides a physical and electrical interface between the antenna 120 and the transmission line 112. This enables the antenna 120 to transmit RF signals to the control unit 114 through the transmission line 112. The RF feed structure 122 includes a transmission line port (FIG. 5) which enables connection of the transmission line 112 without incurring the high cost of a custom, high-precision RF connector.

Figure 3:
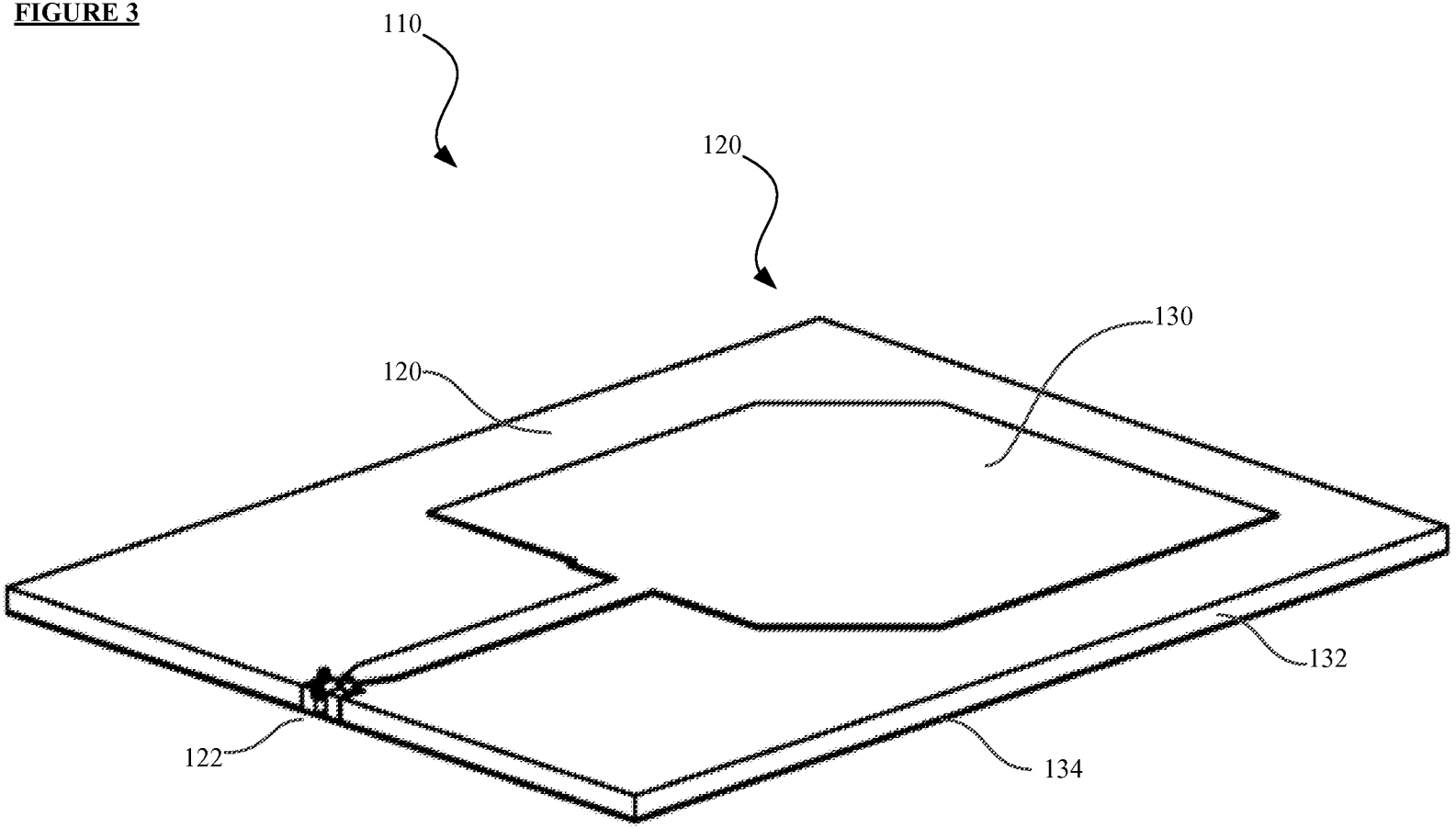
FIG. 3 is a top view of an example of an antenna subsystem of an RFID tag reader system.

FIG. 3 is a top view of one example of the antenna subsystem 110, having antenna 120 and RF feed structure 122. In the example, the antenna 120 includes one antenna having a signal layer 130, a middle layer 132, and a ground plane 134.

The signal layer 130 is a thin layer of conductive material which, when excited through by transmission line 112, allows the antenna 120 to resonate at a desired frequency. In the example, the signal layer 130 is stamped with an RF geometry configured to produce the appropriate resonating qualities. In other embodiments, the signal layer 130 may be shaped in various other appropriate geometric shapes. In the example, the signal layer 130 utilizes a relatively low-cost conductive material, for example, copper, which is easily affixed as part of the antenna 120. The underside of the signal layer 130 is coated with an adhesive layer (not shown) which provides the adhesion between the signal layer 130 and the middle layer 132.

In yet another possible embodiment, the signal layer 130 is printed or otherwise applied onto the middle layer 132, such as using a conductive ink or a conductive paste. As one example, a mask layer (not shown in FIG. 3) is first applied to portions of the middle layer 132 surrounding the desired antenna locations. A printing, painting, spraying, or deposition process can be used to apply a conductive material onto the middle layer 132 and the mask layer. The mask layer is then removed, leaving the signal layer 130, and removing excess conductive material that was applied to the mask.

The middle layer 132 provides the spacing and rigidity needed for the antenna 120 to resonate at a desired frequency. For the antenna 120 to function properly, the signal layer 130 is suspended above the ground plane 134. In the example, the middle layer 132, having a permeability constant very close to that of air (which has a permeability constant of 1.0) due to containing a large proportion of air, acts as an air gap when inserted between the signal layer 130 and the ground plane 134. The middle layer 132 has a thickness associated with the amount of spacing mathematically necessary to provide the appropriate resonating properties to the antenna 120. In the present embodiment, the middle layer is made from a foam board which simulates an air gap while providing such functionality at a low cost. In other embodiments, the middle layer 132 may be formed from any material that can replicate the properties associated with an air gap.

The ground plane 134 is a sheet of conductive material which acts to ground the antenna 120. The ground plane 134 is positioned below the middle layer 132, which acts to space the signal layer 130 and the ground plane 134, as described above. The RF feed structure 122 acts to connect the port 146 to the ground plane 134, as will be described in more detail below.

Figure 4:
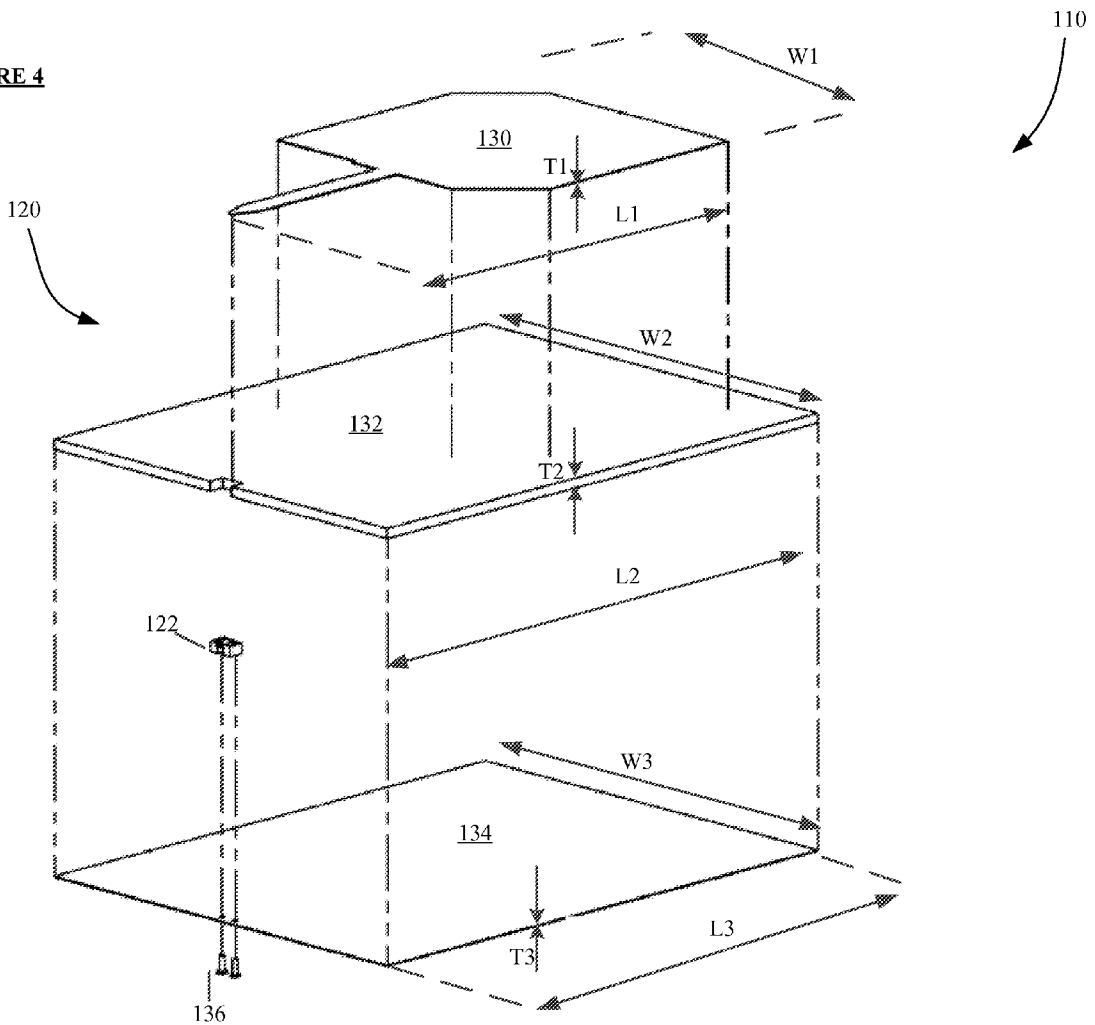
FIG. 4 is an exploded view of an example of the assembly of an antenna subsystem of an RFID tag reader system.

FIG. 4 is an exploded perspective view of one example of the assembly of antenna subsystem 110. The assembly includes the signal layer 130, the middle layer 132, the RF feed structure 122, and the ground plane 134. The RF feed structure 122 also includes fasteners 136. In the example, measurement widths W1, W2, and W3, lengths L1, L2, and L3, and thicknesses T1, T2, and T3 are further shown.

In the example, the RF feed structure 122 is connected to the ground plane 134 through the fasteners 136. The fasteners 136 provide structural and electrical connections between the RF feed structure 122 and the ground plane 134. The fasteners 136 can be any suitable connector including, but not limited to, rivets, bolts, screws, metal posts, electrical vias, or the like.

In some embodiments, the RF feed structure 122 is positioned within a notch in the middle layer 132. Once assembled, the signal layer 130 is positioned over the RF feed structure 122 so that there is direct electrical communication between the RF feed structure 122 and the signal layer 130. In alternative embodiments (as described below), the signal layer 130 may be indirectly connected to the RF feed structure 122 through a conductor.

Some embodiments have dimensions as illustrated in FIG. 4. Examples of those dimensions include the following. The signal layer 130 has the dimensions L1, W1, T1. Length L1 is the length of the signal layer 130. Length L1 is typically in a range from about 7.17 inches to about 7.23 inches. Width W1 is the width of the signal layer 130. Width W1 is typically in a range from about 4.17 inches to about 4.27 inches. Thickness T1 is the thickness of the signal layer 130. Thickness T1 is typically in a range from about 4 to about 6 mils. Other embodiments of the signal layer 130 have other dimensions.

The middle layer 132 has the dimensions L2, W2, T2. Length L2 is the length of the middle layer 132. Length L2 is typically in a range from about 10.7 inches to about 11.3 inches. Width W2 is the width of the middle layer 132. Width W2 is typically in a range from about 6.7 inches to about 7.3 inches. Thickness T2 is the thickness of the middle layer 132. Thickness T2 is typically about 3/16 inch. Other embodiments of the middle layer 132 have other dimensions.

The ground plane 134 has the dimensions L3, W3, T3. Length L3 is the length of the ground plane 134. Length L3 is typically in a range from about 10.7 inches to about 11.3 inches. Width W3 is the width of the ground plane 134. Width W3 is typically in a range from about 6.7 inches to about 7.3 inches. Thickness T3 is the thickness of the ground plane 134. Thickness T3 is typically in a range from about 55 mil to about 100 mil. Other embodiments of the ground plane 134 have other dimensions.

Figure 5:
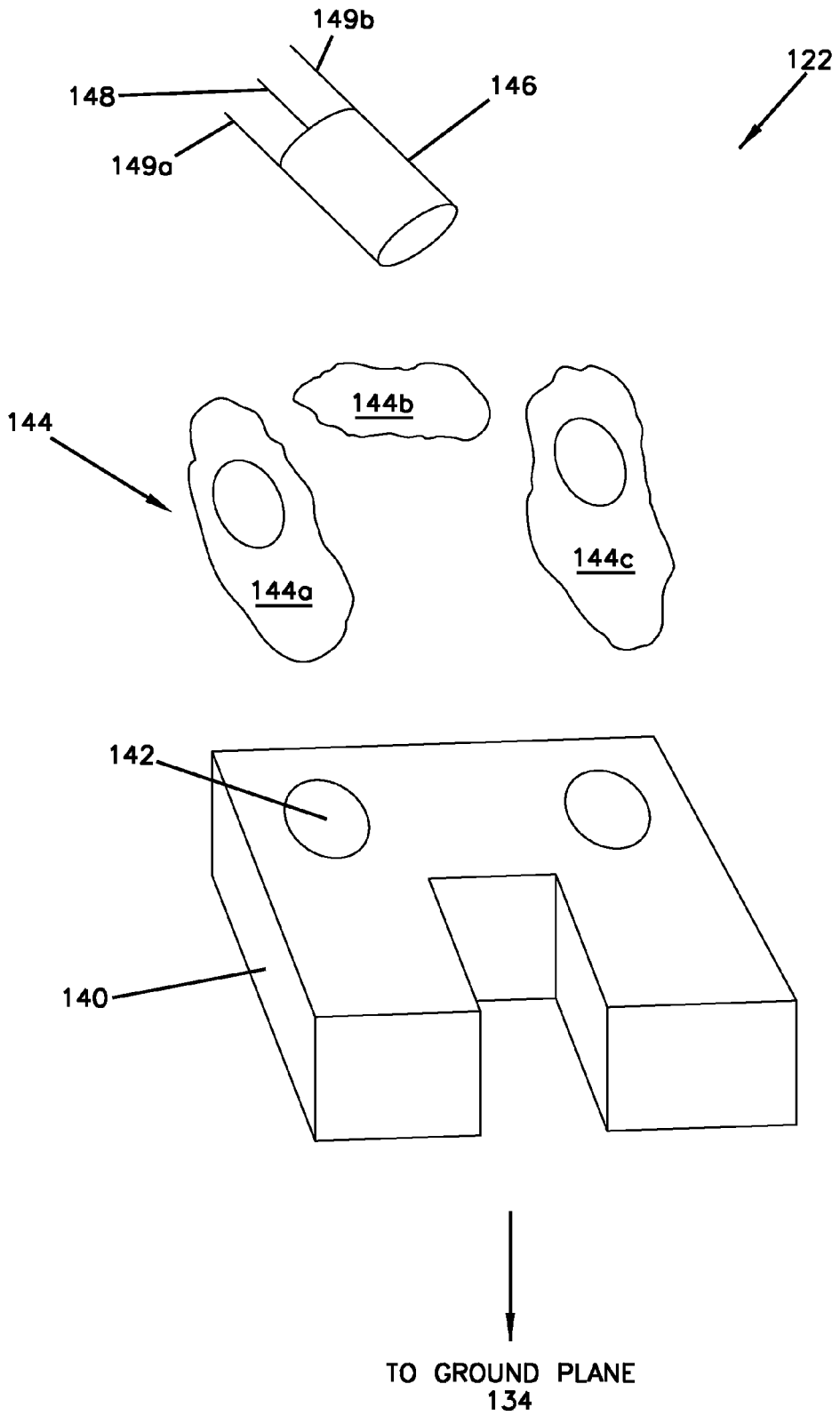
FIG. 5 is an exploded perspective view of an example of the assembly of an RF feed structure of an antenna subsystem.

FIG. 5 is an exploded perspective view of the assembly of the RF feed structure 122. The RF feed structure 122 includes a substrate 140, fastener apertures 142, a conductive layer 144, and a port 146. The conductive layer 144 includes conductive portions 144*a*, 144*b*, and 144*c*. The port 146 includes a signal pin 148 and ground pins 149*a* and 149*b*.

The substrate 140 is a base layer for constructing the RF feed structure 122. In the example, the substrate 140 is made from FR-4 board and fiberglass resin, due to its inexpensive, lightweight, yet robust properties. Furthermore, FR-4 board can be processed using standard printed circuit board fabrication techniques, thereby simplifying the manufacturing process. In some embodiments, the substrate may be formed by materials capable of providing a suitable base for the RF feed structure 122 including, but not limited to, any other substrates suitable for manufacturing printed circuit boards. In the example, the substrate 140 is positioned above the ground plane 134 so that the RF feed structure 122 can be structurally and electrically connected to the ground plane 134. However, it is understood that in alternate embodiments, the substrate 140 may be positioned in a variety of orientations, as long as some electrical connection exists between the RF feed structure 122 and the ground plane 134.

In some embodiments, the substrate 140 includes fastener apertures 142. The fastener apertures 142 enable connection of the fasteners 136, which provide both the structural and electrical coupling of the RF feed structure 122 to the ground plane 134. In this way, the fastener apertures form a ground plane interface of the RF feed structure 122. The fastener apertures 142 can be sized and shaped to support any number of chosen fasteners, including, but not limited to, rivets, bolts, screws, metal posts, or the like. In alternate embodiments, the fastener apertures 142 may be electrical vias which provide an electrical connection between the RF feed structure 122 and the ground plane 134, thereby providing a ground plane interface. In yet further embodiments, the substrate 140 may include only one or several apertures 142, as required by the antenna subsystem 110 for physical and electrical connectivity.

The conductive layer 144 is deposited on the substrate 140 during the manufacturing process. The conductive layer 144 provides the electrical connectivity necessary for the RF feed structure 122 to communicate with the signal layer 130. The conductive portion 144*b* provides a signal from the transmission line 112 to the signal layer 130. The conductive portions 144*a,c* connect ground pins 149*a,b* to a ground. In the example, the conductive layer 144 is a thin film of copper; however, it is understood that the conductive layer 144 may be any conductive material that can be deposited on the substrate 140 to provide the electrical connectivity necessary. In one example, the signal layer 130 is placed on the conductive layer 144 and soldered to provide a direct connection from the RF feed structure 122 to the signal layer 130. Alternatively, the conductive layer 144 can be connected by other fasteners, such as a conductive adhesive. This method of electrical connection eliminates the need for an assembler to hand-solder components together, thereby accelerating the manufacturing process. In yet another example, a conductor (see, for example, FIG. 8) may be extended from the conductive layer 144 to the signal layer 130 to provide the necessary connection.

The port 146 is a connector configured to receive the transmission line 112. The RF feed structure 122 acts like a signal feed, which accepts a signal from the transmission line 112 through the port 146 and transmits the signal to the signal layer 130 so that the signal layer 130 can resonate at the appropriate levels. In the example, the port 146 is rigidly connected to the substrate 140 with a fastener, such as a solder joint, a weld joint, a fused joint, conductive adhesive, and other fasteners suitable for joining the two components. The signal pin 148 on the port 146 is also connected to the conductive layer 144 on substrate 140 so that it is in electrical communication with the conductive layer 144. In this way, the RF feed structure 122 functions as a coupling device configured to transmit a signal from the signal pin 148 through the conductive portions 144*b* to the signal layer 130. The conductive portion 144*b* is electrically coupled to the signal layer 130, such as by arranging the end of the signal layer 130 on conductive portion 144*b* and electrically coupling them together. Fasteners such as a solder joint or conductive adhesive can be used to form a physical and electrical connection between the conductive portion 144*b* and the end of the signal layer 130. The ground pins 149*a,b* are coupled to the conductive portions 144*a, c*, respectively, to provide a ground connection.

In some embodiments, the RF feed structure 122 is configured to receive a cable matched for 50 ohms. In other possible embodiments, the port 146 is a MMCX connector capable of receiving a coaxial cable. The port 146 has a 50 ohm impedance and is designed for applications around the 915 MHz center frequency. The port 146 may utilize any RF connector; however, a MMCX connector is generally preferred over a specially-milled, high-precision RF connector due to its lower cost. The MMCX connector has a snap-in type connector, rather than a larger a screw-in coaxial header, providing a reduced profile. The MMCX connector is typically free of threadings. Though the port 146 of the example embodiment was described above in detail, it is understood that the port 146 may be configured to utilize various connectors capable of accepting the transmission line 112, depending on the variety of transmission line 112 that is being used by the system.

Figure 6:
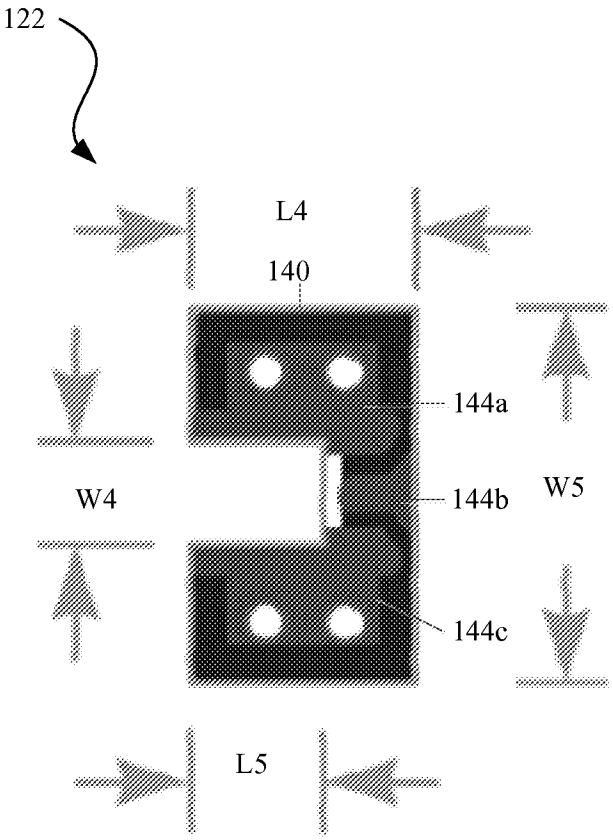
FIG. 6 is a top view of an example of an RF feed structure of an antenna subsystem.

FIG. 6 is a top view of the RF feed structure 122. In the example, lengths L4 and L5 and widths W4 and W5 are shown. Some embodiments of the RF feed structure 122 have dimensions as illustrated in FIG. 6. Examples of those dimensions include the following.

The RF feed structure 122 has the dimensions L4, L5, W4, and W5. Length L4 is the length of the substrate 140 when molded into the geometric shape illustrated. Length L4 is typically in a range from about 0.100 to 0.500 inches. Length L5 is a measurement of the distance between a side of the substrate 140 and the position at which the end of the port 146 extends above the substrate 140. Length L5 is typically in a range from about 0.005 to 0.300 inches. W4 is the width of the port 146. Width W4 is typically in a range from about 0.005 to 0.002 inches. W5 is the width of the substrate 140. Width W5 is typically in a range from about 0.300 to 0.700 inches.

Other embodiments of the RF feed structure 122 have other dimensions. The measurements can be affected based on a variety of factors including, but not limited to, the geometric shape of the substrate 140, the type of port 146 and transmission line 112 used in the antenna subsystem 110, the form of fasteners 136 used, and numerous other like considerations.

Figure 7:
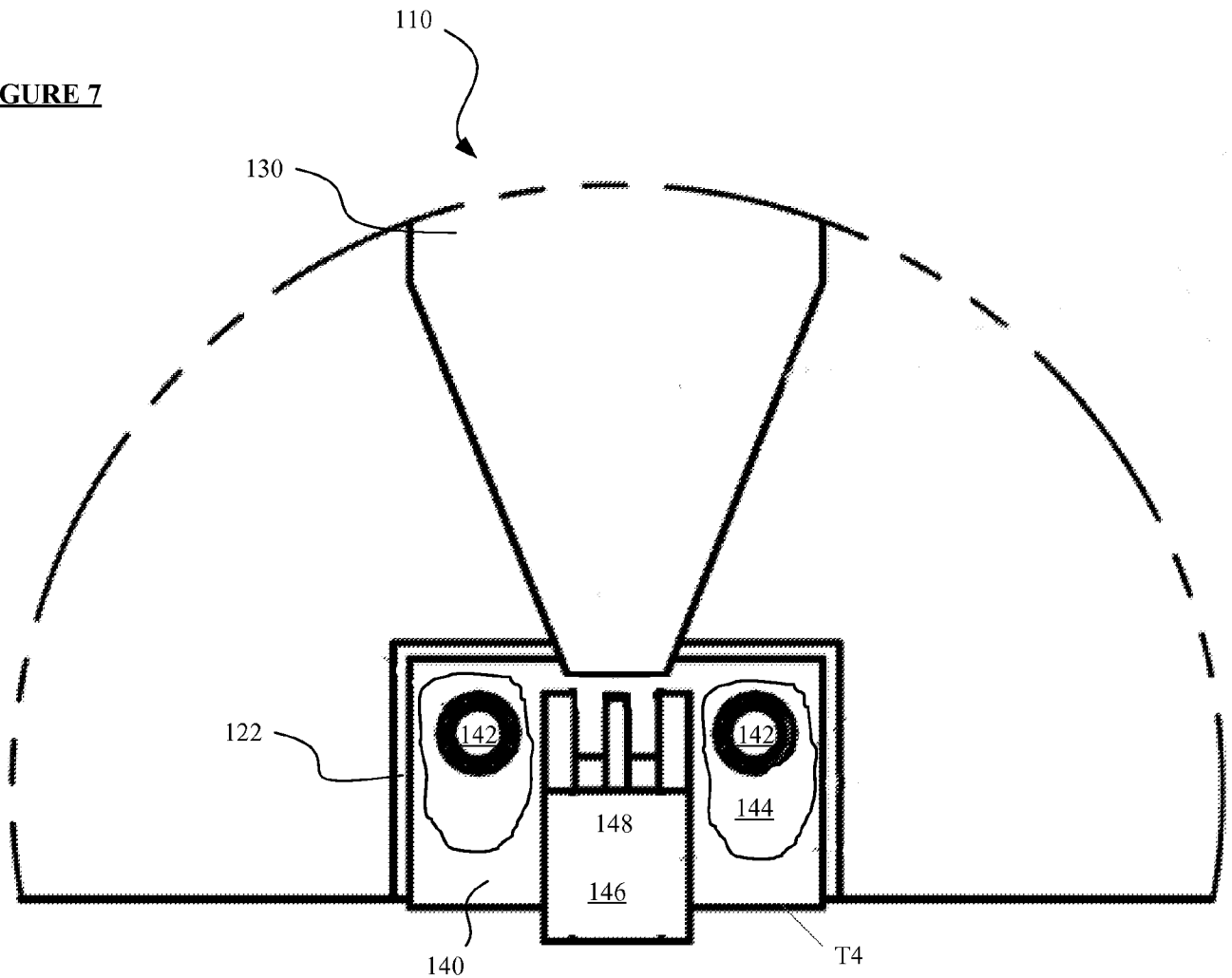
FIG. 7 is a top view of an RF feed structure of an antenna subsystem.

FIG. 7 is a top view of an example of the configuration of the RF feed structure 122 and its connection to the antenna 120. In the example, the RF feed structure 122 and the signal layer 130 is shown. The RF feed structure 122 further includes the substrate 140, the conductive layer 144, the fastener apertures 142, the port 146, the signal pin 148, and thickness T4.

As illustrated, the signal layer 130 is in electrical communication with the signal pin 148 of the port 146. In this way, the transmission line 112 can be connected to the port 146. A signal sent through the transmission line 112 is then transmitted through the signal pin 148 to the conductive layer 144 and further to the signal layer 130. The fastener apertures 142 and/or additional vias provide a ground connection to the ground plane 134 (shown in FIGS. 3-4), positioned below the RF feed structure 122. The thickness T4 represents the thickness T2 of the middle layer (FIG. 4). Because both thicknesses T2 and T4 are the same, the signal layer 130 receives the transmitted signal from the RF feed structure 122 in circumstances that allow the signal layer 130 to resonate appropriately.

In addition to the components illustrated herein, in some embodiments the RF feed structure 140 further includes additional active and/or passive electronic components. For example, electronic components can be electrically arranged between signal pin 148 and signal layer 130. As one example, the electronic components can split a signal from the signal pin into two or more feeds. The separate feeds can then be provided to separate feedpoints of one or more signal layer 130. The separate feeds can be selectively controlled by the electronic components. Electronic components can also be coupled to the ground plane, if desired, by connection with one or both of the conductive portions 144*a* and 144*c*. However, some embodiments are free of additional electronic components, other than those illustrated, for example, in FIGS. 5 and 6.

Figure 8:
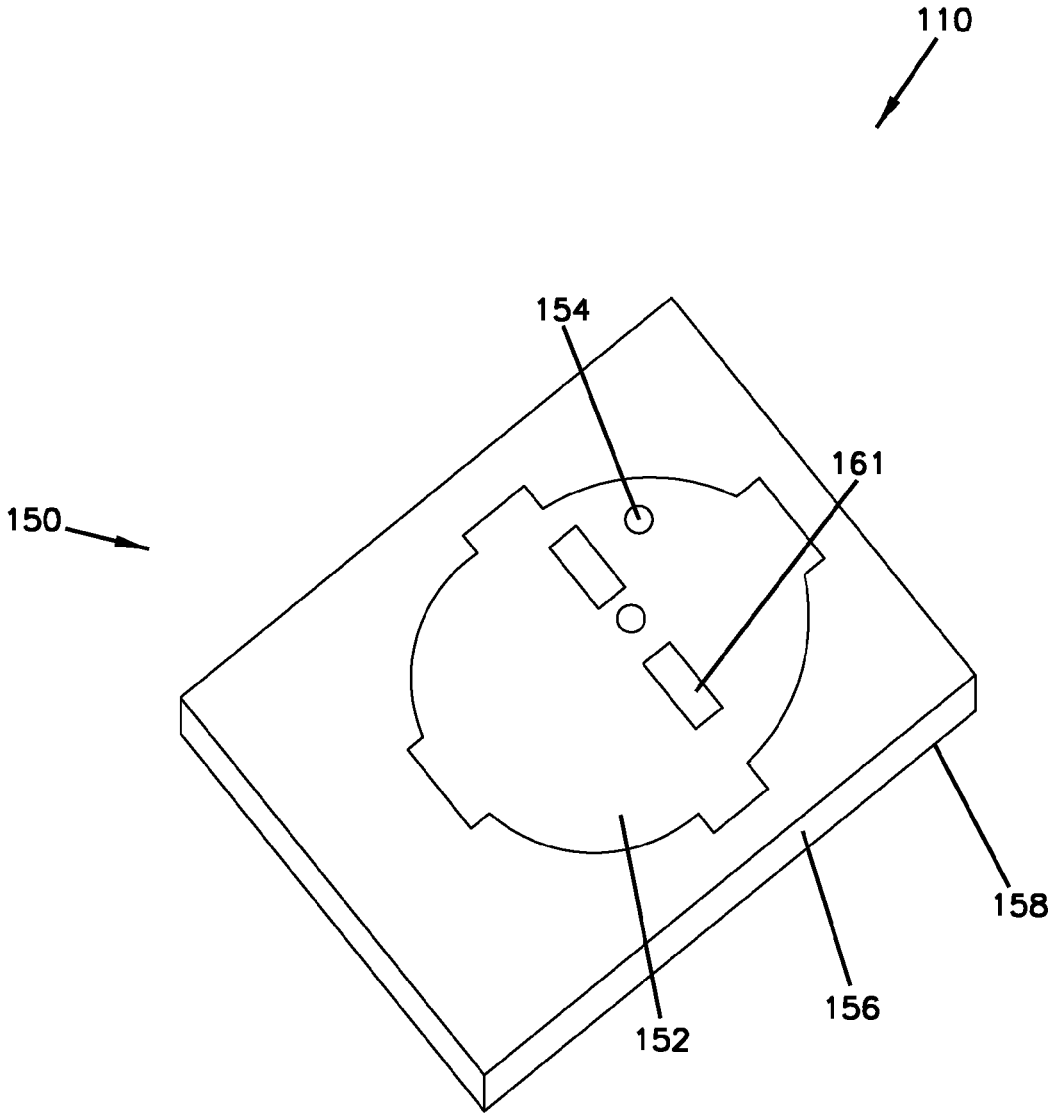
FIG. 8 is a top view of another example of an antenna subsystem of an RFID tag reader system.
Figure 9:
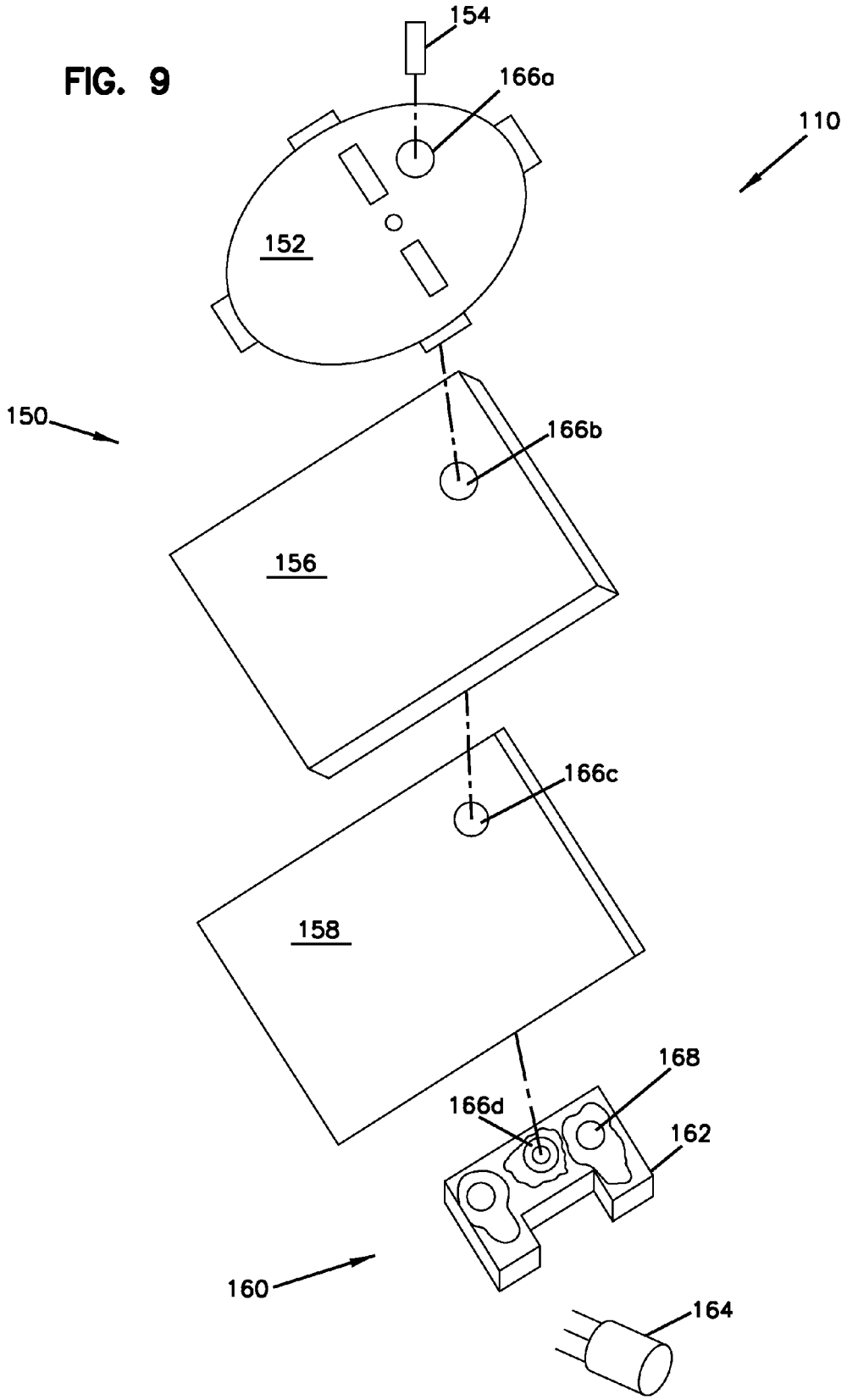
FIG. 9 is an exploded perspective view of the example of the antenna subsystem of the RFID tag reader system, shown in FIG. 8.

FIG. 8 is a top view of an alternate example of the antenna subsystem 110, having an antenna 150 and an RF feed structure 160 (FIG. 9). In the example, the antenna 150 has a signal layer 152, a conductor 154, a middle layer 156, a ground plane 158. The signal layer 152 also has cutouts 161.

The signal layer 152 operates similarly to the signal layer 130 (described above); however, the signal layer 152 is stamped with an alternative RF geometry. In the example, the signal layer 152 includes cutouts 161, which are designed in such a way to allow antenna 150 to resonate at a desired frequency. In the example, the signal layer 130 utilizes a low-cost conductive material, for example, copper, which is easily affixed to the antenna 150. The underside of the signal layer 152 is coated with an adhesive layer (not shown) which provides adhesion between the signal layer 152 and the middle layer 156.

The antenna 150 also includes a conductor 154 which is visible through the top surface of the signal layer 152. The conductor 154 is a connector which extends through the antenna 150 to provide connectivity between the RF feed structure 160, positioned below the ground plane 158, and the signal layer 152. In the example, the conductor 154 is a metal post; however, it is understood that the conductor 154 may be any connector capable of extending through the antenna 150 to electrically couple the RF feed structure 160 with the signal layer 152. The middle layer 156 and the ground plane 158 each include apertures (not shown) which allow the conductor 154 to extend through to enable the transmittal of a signal from the RF feed structure 160 the signal layer 152.

FIG. 9 is an expanded view of an assembly of the antenna subsystem 110 shown in FIG. 8. In the example, the antenna 150 and the RF feed structure 160 are shown in greater detail. The antenna 150 includes the signal layer 152, the conductor 154, the middle layer 156, and the ground plane 158. The signal layer 152, the conductor 154, the middle layer 156, the ground plane 158 and the RF feed structure 160 all include apertures 166*a-d*, respectively. The RF feed structure 160 further includes a substrate 162, a port 164, and fastener apertures 168.

In the example, the assembly of antenna 150 is shown. The placement of the conductor 154, through the antenna subsystem 110 is illustrated. As shown, the conductor 154 extends through the signal layer 152, the middle layer 156, the ground plane 158, and the RF feed structure 160 through the apertures 166*a-d*.

The RF feed structure 160 is positioned below the ground plane 158. The RF feed structure includes the substrate 162 and the port 164. The substrate 162 and the port 164 are designed and function similarly to the substrate 140 and the port 146 of the embodiments illustrated in FIGS. 5-7. However, the substrate 162 includes an aperture 166*d* configured to accept the conductor 154. The apertures 166*b-d* have a diameter slightly larger than the diameter of the conductor 154. As such, the conductor 154 may fit through the apertures 166*b-d* without coming in contact with any of the planes. In this way, the signal passed from the port 164 to the signal layer 152 is undisturbed by electrical interference from any of the intermediate planes. The aperture 166*a*, however, is configured in such a way that the conductor 154 contacts the signal layer 152. Thus, the RF feed structure 160 is in electrical communication with the signal layer 152 through the conductor 154. The RF feed structure 160 also includes fastener apertures 168. The fastener apertures 168 and associated conductive portions function similar to the previously described fastener apertures 142 in function, and physically and electrically connect the RF feed structure 160 with the ground plane 158, thereby forming a ground plane interface of the RF feed structure 160.

Figure 10:
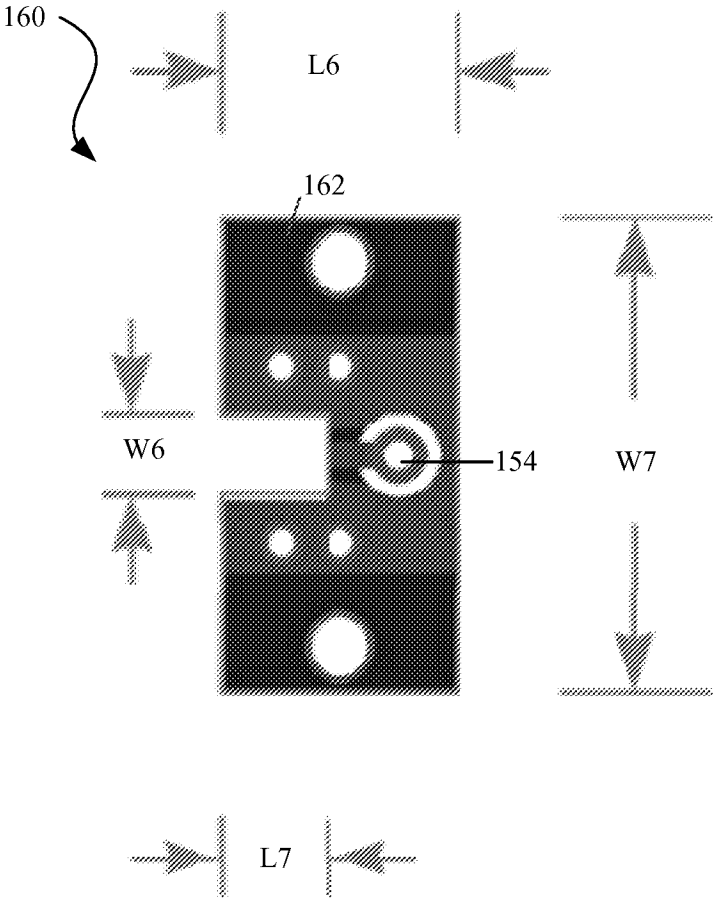
FIG. 10 is a top view of the example of the RF feed structure of the antenna subsystem, shown in FIG. 8.

FIG. 10 is a top view of the RF feed structure 160. In the example, lengths L6 and L7 and widths W6 and W7 are shown. Some embodiments of the RF feed structure 160 have dimensions as illustrated in FIG. 10. Examples of those dimensions include the following.

The RF feed structure 160 has the dimensions L6, L7, W6, and W7. Length L6 is the length of the substrate 162 when molded into the geometric shape illustrated. Length L6 is typically in a range from about 0.200 to 0.600 inches. Length L7 is a measurement of the distance between a side of the substrate 140 and the position at which the end of the port 164 extends above the substrate 162. Length L7 is typically in a range from about 0.005 to 0.300 inches. W6 is the width of the port 164. Width W6 is typically in a range from about 0.005 to 0.200 inches. W7 is the width of the substrate 162. Width W7 is typically in a range from about 0.600 to 1.00 inches.

Other embodiments of the RF feed structure 160 have other dimensions. The measurements can be affected based on an assortment of factors including, but not limited to, the geometric shape of the substrate 162, the type of port 164 and transmission line 112 used in the antenna subsystem 110, the form of fasteners 136 used, and various other considerations.

The various embodiments described above are provided by way of illustration only and should not be construed to limit the claims attached hereto. Those skilled in the art will readily recognize various modifications and changes that may be made without following the example embodiments and applications illustrated and described herein, and without departing from the true spirit and scope of the following claims.

What is claimed is:

1. A radio frequency (RF) feed structure comprising:

a substrate;

at least one port coupled to the substrate and arranged and configured for selective coupling with a transmission line, the port providing an electrical connection with a signal conductor of the transmission line and an electrical connection with a ground conductor of the transmission line;

a conductive layer arranged on at least one surface of the substrate, the conductive layer including at least a first portion and a second portion, wherein when the transmission line is coupled to the port, the first portion is electrically coupled to the signal conductor through the port, the first portion is arranged and configured to feed the signal to a feedpoint of a signal layer of an antenna, and the second portion is electrically coupled to the ground conductor through the port; and a ground plane interface configured to make an electrical connection with a ground plane of a radio frequency antenna, to electrically couple the ground plane with the second portion of the conductive layer and the ground conductor of the transmission line.

2. The RF feed structure of claim 1, wherein the port is configured for selective coupling with a coaxial cable.

3. The RF feed structure of claim 1, further comprising at least one fastener configured to connect the substrate to the ground plane of the radio frequency antenna.

4. The RF feed structure of claim 1, wherein the fastener is a rivet and wherein the substrate comprises a fastener aperture configured to receive a portion of the rivet.

5. The RF feed structure of claim 1, wherein the fastener is a conductive adhesive.

6. The RF feed structure of claim 1, further comprising at least one active or passive electronic device operable to condition the signal between the port and the feedpoint of the signal layer.

7. A radio frequency (RF) antenna and feed structure comprising:

an antenna comprising:

a signal layer;

a ground plane layer; and a middle layer positioned between the signal layer and the ground plane layer; and at least one RF feed structure comprising:

a substrate;

at least one port coupled to the substrate and arranged and configured for selective coupling with a transmission line, the port providing an electrical connection with a signal conductor of the transmission line and an electrical connection with a ground conductor of the transmission line; and a conductive layer arranged on at least one surface of the substrate, the conductive layer including:

a first portion electrically connected to the signal layer and electrically connected to the signal conductor to conduct a signal between the signal conductor and the signal layer; and a second portion electrically connected to the ground plane and electrically connected to the ground conductor.

8. The RF antenna and feed structure of claim 7, wherein the port is an MMCX connector.

9. The RF antenna and feed structure of claim 7, wherein the RF feed structure is directly soldered to the signal layer.

10. The RF antenna and feed structure of claim 7, wherein the RF feed structure is passively contacted to the patch layer with a conductive adhesive.

11. The RF antenna of claim 7, wherein the RF feed structure is indirectly connected to the signal layer through a metal post.

12. The RF antenna and feed structure of claim 7, wherein the signal layer is metal and the middle layer is foam.

13. The RF antenna and feed structure of claim 7, wherein the signal layer is formed of a conductive ink, paste, or paint applied to the middle layer.

14. The RF antenna and feed structure of claim 7 wherein the ground plane is an aluminum plate.

15. The RF antenna and feed structure of claim 7, further comprising a ground plane interface including an electrical via extending through the substrate.

16. A method for manufacturing a radio frequency antenna and feed structure, the method comprising:

forming a signal layer from a first conductive material;

forming a middle layer from an electrically insulating material;

forming a ground plane from a second conductive material;

arranging the middle layer between the signal layer and the ground plane;

forming at least one RF feed structure including at least a substrate and a port configured to receive a coaxial cable;

physically connecting the substrate of the RF feed structure to the ground plane with at least one fastener; and electrically coupling the RF feed structure to the signal layer and to the ground plane, wherein the RF feed structure transfers a radio frequency signal between the coaxial cable and the signal layer.

17. The method of claim 16, wherein forming an RF feed structure comprises:

rigidly connecting the port to a substrate;

forming at least one fastener aperture in the substrate, the at least one fastener aperture configured to receive a fastener therein to physically connect the substrate to the ground plane; and forming a conductive layer on the substrate, the conductive layer configured to transmit a signal from a signal pin of the port to the signal layer.

18. The method of claim 16, wherein electrically coupling the RF feed structure to the signal layer comprises connecting a feedpoint of the signal layer with a conductive layer of the RF feed structure with a fastener.

19. The method of claim 16, wherein electrically coupling the RF feed structure to the signal layer comprises inserting a metal post through an aperture in the substrate and the signal layer and electrically connecting the metal post to the signal layer.

* * * * *